US005117987A

United States Patent [19]

Lombardo

[11] Patent Number: 5,117,987

[45] Date of Patent: Jun. 2, 1992

[54] GARMENT SUPPORT

[76] Inventor: John Lombardo, P.O. Box 72390, Fairbanks, Ak. 99707

[21] Appl. No.: 702,684

[22] Filed: May 20, 1991

[51] Int. Cl.[5] ..... A47H 1/02

[52] U.S. Cl. ..... 211/105.1; 211/123; 248/205.1

[58] Field of Search ..... 248/339, 205.1, 219.2; 211/123, 105.1, 105.2, 105.3, 105.4, 106, 87

[56] References Cited

U.S. PATENT DOCUMENTS

| | | | |
|---|---|---|---|
| 360,577 | 4/1887 | Fisher | 211/32 |
| 1,751,691 | 3/1930 | Flath . | |
| 2,487,652 | 11/1949 | Heinrich | 211/106 X |
| 2,512,397 | 6/1950 | Trautner | 248/205 |
| 2,539,803 | 1/1951 | Westberg | 211/105.1 X |
| 2,804,278 | 8/1957 | Jewett | 248/205.1 |
| 2,895,698 | 7/1959 | Palmer | 248/205 |
| 2,896,791 | 7/1959 | Raber | 211/86 |
| 3,145,849 | 8/1964 | Hanson | 211/105.1 |
| 3,158,132 | 11/1964 | Guthrie | 248/205.1 X |
| 3,825,127 | 7/1974 | Morrison | 211/96 |
| 4,721,212 | 1/1988 | Lowe | 211/86 |
| 4,930,738 | 6/1990 | Lombardo | 248/205 |

*Primary Examiner*—J. Franklin Foss

[57] ABSTRACT

The invention discloses a garment support to be detachably mounted upon a door hinge of the type having intermeshing sleeves held together by a hinge pin.

The invention comprises a hinge mounting member and a main body member. The hinge mounting member is substantially flat and elongated in shape containing an angled slot at one end capable of receiving the shaft of a hinge pin, and a centered oblong aperture. The main body member is substantially rectangular in shape containing an L-shaped end and a plurality of supports, whereby garments and other articles may be suspended.

2 Claims, 1 Drawing Sheet

GARMENT SUPPORT

BACKGROUND

1. Field of Invention

The present invention relates to garment supports for being detachably mounted upon a door hinge of the type comprising two leaves joined through intermeshed sleeves held together by a hinge pin.

2. Description of Prior Art

Many residents of houses, apartments and offices find it convenient to attach hooks, for hanging garments and other articles, directly to the surface of a door. The hooks are commonly fastened to the door with screws, which damages the door. Many interior doors have a hollow core that will not hold a screw securely so the mounting will eventually fail. An adhesive backed type hook may be employed, but this type of mounting does not hold much weight and will eventually fail.

Heretofore a few devices have been developed that mount to a door hinge for the purpose of hanging clothing. Many of the prior devices require the removal and subsequent replacement of the hinge pin to mount the device.

Other prior devices require the use of a replacement hinge pin to mount the device. Most of the prior devices were made to extend outwardly from the door hinge and very often detract from the interior decoration of the room.

The present invention was developed to conveniently mount to a door hinge, thereby providing a support for hooks or the like, to hang garments and other articles, that overcomes the prior art deficiencies.

SUMMARY OF THE INVENTION

Accordingly, the primary object of the present invention is to provide a support for hooks or the like to be detachably mounted upon a door hinge.

Another object of the present invention is to provide a garment support to be detachably mounted upon a door hinge quickly and easily without the necessity of removing or replacing the hinge pin of the door hinge.

A further object of the present invention is to provide a garment support to be detachably mounted upon a door hinge that will be considered an attractive furnishing that complements the interior decoration of any room.

A still further object of the present invention is to provide a garment support to be detachably mounted upon a door hinge, thereby eliminating the use of screws or similar fasteners to mount the device.

These and other objects and advantages of the present invention will become apparent from a consideration of the drawings and ensuing description.

DESCRIPTION OF THE PREFERRED EMBODIMENT

Figure 1:
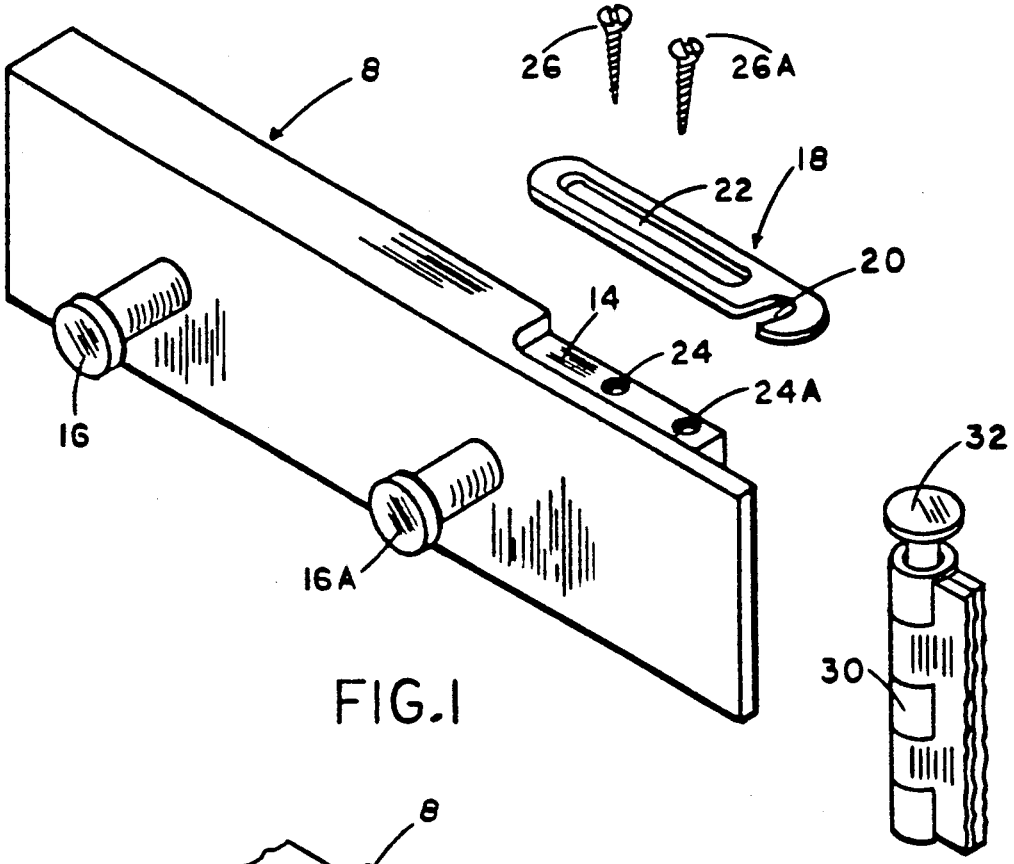
FIG. 1 is a perspective view illustrating the main body member and the hinge mounting member in their unconnected condition for a right side mounting, and a door hinge.
Figure 2:
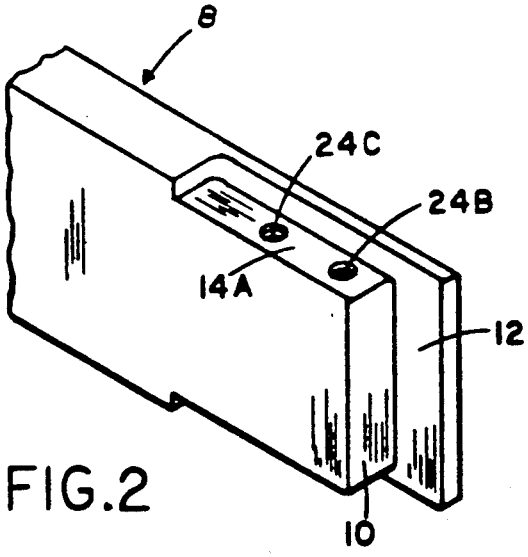
FIG. 2 is a perspective view illustrating the backside of the main body member.
Figure 3:
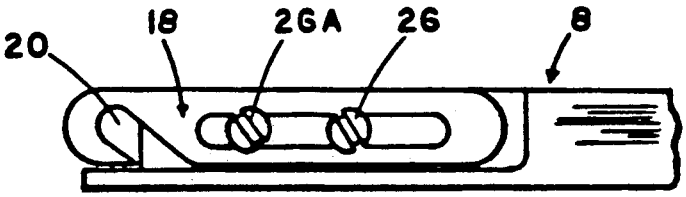
FIG. 3 is a top view illustrating the hinge mounting member and the main body member in their connected condition for a left side mounting.

Referring to FIGS. 1-3 of the drawings the present invention comprises, a main body member 8 and a hinge mounting member 18.

Main body member 8 is preferably formed from wood such as oak, substantially rectangular in shape comprising base surface 10 and side surface 12 (which are vertically disposed and adjoin at a right angle to form a substantially L-shaped end), recessed surface 14 and 14A, and garment supports 16 and 16A.

Base surface 10 is formed at one end along the width of main body member 8 and has a width approximately equal to the width of the intermeshing sleeves of door hinge 30.

Side surface 12 is formed along the width of main body member 8 adjoining base surface 10 at a right angle and has a width slightly less than the width of base surface 10.

Recessed surface 14 and 14A are formed perpendicular to base surface 10, extending from base surface 10 approximately the length of hinge mounting member 18, with a sufficient depth to hide hinge mounting member 18 and screws 25 and 26A from view.

Bores 24, 24A and bores 24B, 24C are formed on center therein recessed surface 14 and 14A respectively, and sized to receive screws 26 and 26A to facilitate the detachable connection of hinge mounting member 18 to main body member 8.

Garment supports 16 and 16A are preferably oak or brass and comfortably spaced along the front surface of main body member 8.

Referring to FIGS. 1 and 3 of the drawings, hinge mounting member 18 is substantially flat and elongated in shape, preferably formed from metal comprising slot 20 and oblong aperture 22.

Slot 20 is formed near an end of hinge mounting member 18, sidewardly opening and angled at 45 degrees toward the opposite end, and sized to receive the shafts of hinge pin 32 therethrough, Oblong aperture 22 extends along the length of hinge mounting member 18, aligned on center and of sufficient length and width to receive screws 26 and 26A therethrough to facilitate the detachable connection of hinge mounting member 18 to main body member 8 and door hinge 30.

OPERATION OF THE INVENTION

Referring to FIGS. 1-3 of the drawings, place hinge mounting member 18 therein recessed surface 14 or 14A (depening on right or left side mounting) so that the opening of slot 20 is facing wide surface 12. Loosely insert screw 26A therethrough oblong aperture 22 and into bore 24A or 24B. Slightly raise hinge pin 32. Slide slot 20 around the shaft of hinge pin 32. Abut base surface 10 of main body member 8 to the intermeshing sleeves of door hinge 30. Tighten screw 26A. Insert screw 25 into bore 24 or 24C and tighten.

The present invention will pivot around the intermeshing sleeves of door hinge 30. Downward and twisting forces will be restrained by the working combination of slot 20, base surface 10 and side surface 12.

If desired, main body member 8 may be temporarily connected to the surface of the door. This insures the present invention will follow the door during operation of the door. A hook and loop type fastener, commonly known as VELCRO, works extremely well for this purpose and is readily available in retail stores.

Thus, the present invention will be found useful and convenient as an attractive garment support to be detachably mounted upon a door hinge in any room of a home or office.

While the above description contains many specificities, these should not be construed as limitations, but rather as an example of the preferred embodiment thereof. There are possible variations. For example, those skilled in the art can use alternative materials such as molded plastic. They can add another slot to the opposite end of hinge mounting member 18. They can change the angle of slot 20. They can substitute a round bore for slot 20. Those skilled in the art could provide main body member 8 in a variety of different shapes and sizes. They could put an L-shaped end at each end of main body member 8. They could use threaded bolts instead of bores 24, A, B and C and use wing nuts or decorative knobs instead of screws 26 and 26A.

Accordingly, the scope of the invention should not be determined by the embodiment illustrated, but by the appended claims and their legal equivalents.

Having described the present invention, I claim:

1. A garment support adapted to be detachably mounted upon a door hinge of the type having intermeshing sleeves joined together by a hinge pin comprising:

(a) a hinge mounting member constructed from rigid material substantially flat and elongated in shape containing a sidewardly opening slot, said slot being sized to receive the shaft of said hinge pin therethrough, and an oblong aperture aligned on center along the length of said hinge mounting member and, (b) a main body member constructed from rigid material containing two vertically disposed surfaces that perpendicularly adjoin each other to form a substantially L-shaped end; (c) said hinge mounting member being detachably connected to said main body member wherein said slot is positioned over said L-shaped end and detachably mounted around the shaft of said hinge pin.

2. The invention of claim 1 wherein said main body member is of sufficient dimension to contain a plurality of supports, whereby garments and other articles may be suspended.

* * * * *